US006549164B2

(12) United States Patent
Paschen et al.

(10) Patent No.: US 6,549,164 B2
(45) Date of Patent: Apr. 15, 2003

(54) DISTRIBUTED ADAPTIVE COMBINING SYSTEM FOR MULTIPLE APERTURE ANTENNAS INCLUDING PHASED ARRAYS

(75) Inventors: Dean Alan Paschen, Lafayette, CO (US); Peter Moosbrugger, Erie, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/816,047

(22) Filed: Mar. 22, 2001

(65) Prior Publication Data

US 2002/0135513 A1 Sep. 26, 2002

(51) Int. Cl.[7] ..... H01Q 3/22; H01Q 3/24; H01Q 3/26

(52) U.S. Cl. ..... 342/371; 342/372; 342/375

(58) Field of Search ..... 342/368, 371, 342/372, 375

(56) References Cited

U.S. PATENT DOCUMENTS

| | | | | | |
|---|---|---|---|---|---|
| 3,967,279 | A | | 6/1976 | Zeger | 343/117 |
| 4,060,806 | A | | 11/1977 | Davies et al. | 343/17.7 |
| 4,121,209 | A | * | 10/1978 | Rhys | 343/7.7 |
| 4,155,086 | A | * | 5/1979 | Blair | 343/7 A |
| 4,612,547 | A | * | 9/1986 | Itoh | 343/372 |
| 4,876,548 | A | | 10/1989 | Lopez | 342/368 |
| 5,027,127 | A | | 6/1991 | Shnitkin et al. | 342/372 |
| 5,041,836 | A | | 8/1991 | Paschen et al. | 342/375 |
| 5,043,738 | A | | 8/1991 | Shapiro et al. | 343/700 |
| 5,111,208 | A | * | 5/1992 | Lopez | 342/174 |
| 5,353,032 | A | | 10/1994 | Bertocchi et al. | 342/373 |
| 5,412,414 | A | | 5/1995 | Ast et al. | 342/174 |
| 5,559,518 | A | * | 9/1996 | Didomizio | 342/174 |
| 5,708,442 | A | * | 1/1998 | Whelan et al. | 342/375 |
| 5,767,806 | A | | 6/1998 | Watanabe et al. | 342/373 |
| 5,943,010 | A | * | 8/1999 | Rudish et al. | 342/372 |
| 6,005,515 | A | | 12/1999 | Allen et al. | 342/374 |

* cited by examiner

*Primary Examiner*—Dao Phan
(74) *Attorney, Agent, or Firm*—Sheridan Ross P.C.

(57) ABSTRACT

A phased array type antenna apparatus compensates for phase and time differences between signals received at different elements of the antenna. Each element within the antenna apparatus has an associated phase/time adjuster circuit. The signals from each element are divided, with the first output routed to a combining circuit. The second output of one element is used as a reference signal, with the second output from the remaining elements routed to a switch. One signal is selected at the switch, and is used as a non-reference signal. Phase difference between the reference signal and the non-reference signal is determined at a comparator circuit, and the phase/time adjuster circuit associated with the non-reference signal is adjusted to bring the two signals into phase alignment. Time difference between the reference and non-reference signal is determined using dual correlators and a comparator circuit. The comparator circuit compares the magnitude of an in-phase channel and a quadrature channel from each comparator to determine time difference between the signals. The phase/time adjuster circuit is adjusted to bring the signals into time alignment. When each element is phase and time aligned, the output of the combining circuit is enhanced. Time difference can also be determined for several distinct phased array apertures within an antenna apparatus.

26 Claims, 7 Drawing Sheets

CHANNEL A
CHANNEL B
76
76a
136
192
188
189
184
176
80
132
128
120
124
-1
112
108
104
96
90°
0°
92
72
68
160
164
140
144
116
148
152
156
168
172
120a
116a
72a
68a
133
134
135

DISTRIBUTED ADAPTIVE COMBINING SYSTEM FOR MULTIPLE APERTURE ANTENNAS INCLUDING PHASED ARRAYS

FIELD OF THE INVENTION

This invention relates to an antenna system adapted to provide alignment of several antenna apertures in time to enhance the signal-to-noise ratio in antenna systems.

BACKGROUND OF THE INVENTION

Steerable beam antenna systems typically consist of two basic types-reflector antennas and phased arrays. Although other antenna types exist, such as lens antennas, reflector and phased array antennas are by far the two most common.

Reflector antennas are simple and well understood and make up a significant portion of high gain antenna systems. In order to steer a reflector antenna, a mechanical movement of the entire antenna is usually necessary, although other means such as mechanical or electrical displacement of the feed have also been used. The structure which supports the reflector surface must provide certain precision to maximize the gain of the reflector. Surface deformation considerations can also cause the structural requirements to increase significantly as the size of the antenna increases.

In phased array antennas, the beam is steered electronically and the speed of beam motion is considerably faster than for a reflector antenna, especially for large regions of coverage. However, phased array antennas have several drawbacks. For example, they are typically much more expensive than reflector antennas, the signals sent and received at each element of the array must be phase and time aligned, and the gain of a phased array antenna decreases as the beam is steered off of the antenna boresight.

Current methods for automatic phase aligning a signal compare the phase of two signals using phase detectors, then adjust a phase adjuster associated with one of the signals until a phase difference is no longer detected. This phase alignment of signals from individual elements enhances the signal to noise ratio of the combined received signal from the array antenna. However, if the antenna is receiving a broadband signal, either a high data rate or composite multiple channel signal phase alignment may not result in an optimized signal to noise ratio, since phase alignment can occur in integer wavelength offsets. For relatively small phased array panels, phase alignment alone may be sufficient, as the distance between the center elements and edge elements may not be large enough to result in an integer wavelength offset between signals received at the elements. However, as the panel size in a phased array increases, the distance between the center and edge elements may be large enough to result in an integer wavelength offset between signals from the center elements and edge elements. Thus, for relatively large phased array panels, or widely spaced panels the signals also need to be aligned in time as well as phase to achieve an optimized signal-to-noise ratio for such a system. Signals which require both time and phase alignment to achieve an optimized signal to noise ratio are referred to as broadband signals. To compensate for this possibility, current methods for time aligning signals include using one or more reference signals at different frequencies to determine the required time offset. An external reference signal is sometimes used, which is a signal from a source external to the antenna apparatus which has a set, known frequency which is used to determine time offset between elements in the array. Alternatively, an internal reference signal may be used, which is a signal generated from within the antenna apparatus which is used to determine time offset between elements in the array.

Such a method is described in U.S. Pat. No. 5,041,836. In such a system an external beacon signal separate from the received signal is used to determine the amount of time adjustment required for each antenna element. The separate signals from the elements are first phase aligned, then the beacon signal is checked for phase alignment. The phase detector output will be proportional to the frequency ratio of the received signal and the beacon signal times the number of wavelengths of time delay difference in the received signal at the elements. While this system is successful in time aligning a broadband signal, it has drawbacks. For example, the maximum time delay error which can be detected is a function of the ratio of the frequency of the received signal and the frequency of the beacon signal. Thus, in an example shown in the above-mentioned patent, if the frequency of the received channel is chosen from 7.25–7.31 Ghz, and the beacon frequency is either 7.590 or 7.615 Ghz, the maximum time difference detectable is +/−11 wavelengths, and the maximum uncertainty in the absolute position of the elements must be within 18 inches. If larger time differences or uncertainties in position are required in an application, additional beacon frequencies may be used, or a larger difference in the received signal and beacon signal frequency can be used. If additional beacon signals are used, additional hardware is required, and if a larger difference in frequencies is used ambiguity may result in the smallest time delay bits. Thus, while allowing time alignment of broadband signals, this method requires additional hardware associated with the use of the one or more beacon frequencies, and is limited by ambiguity issues.

Digital hardware may also be used to determine required time offsets needed for each element of an antenna system. In such a case, a digital signal processor analyzes the signals from each element and determines the amount of phase and time shift for each element required to phase and time align all of the elements. In such a case, the digital processing hardware must be used, which can increase the cost of the system, and may also be limited by the signal processing capacity of the digital signal processor.

As mentioned above, the gain of a phased array decreases as the beam is steered off boresight. Due to this decrease in gain, phased array antennas typically are limited to scanning up to 60 conical degrees off the antenna boresight. Additionally, arrays are typically scaled to compensate for this scan loss by adding additional elements or amplifiers, which increases the cost of such an antenna. In order to increase the region of coverage beyond 60 degrees, often several apertures are used with each separate aperture including a separate phased array antenna. In such a case, the separate apertures are placed at angles to one another, with the signal being handed off from one aperture to an adjacent aperture when the scan angle to the first aperture becomes too large. The addition of other apertures allows scan angles beyond 60 degrees, with the signal typically being handed off between adjacent apertures at a scan angle to where the power level is equal between the adjacent faces. While this technique allows larger regions of coverage, several problems can be encountered when a beam is handed off between apertures. For example, phase coherency can be lost, bit synchronization can be lost, and there can be carrier and data drops during a signal handoff between apertures.

SUMMARY OF THE INVENTION

In accordance with the present invention, an antenna apparatus is disclosed that can determine phase and time delay between elements of a single phased array, or between apertures of a multiple aperture phased array antenna without the need for an independent external or internal reference signal. The phase and time delay can be determined using only a single received signal. Thus, there is no need for a separate beacon signal to be received at the antenna apparatus, nor is there a need to generate a separate reference signal within the antenna apparatus. The antenna apparatus includes an array of antenna elements for a single panel antenna, or multiple apertures in a multi-panel antenna. The elements or apertures are connected to at least a receive system which adjusts the received signal from each element or aperture to bring the signal into time and phase alignment. These same adjustments may then be used in a transmit mode to enhance a signal transmitted from the antenna apparatus.

The receive system includes a phase shifter or time delay circuit which is used to phase adjust the signal sent to and received from each element or aperture in order to obtain a phase aligned signal. This is done by analyzing a signal received at each element or aperture of the antenna apparatus. The signal received at a first element or aperture is selected as a reference signal. The signal received at a second element or aperture is then compared to the reference signal, and the signal associated with the second element or aperture is then adjusted based on a phase difference between the two signals. The signal received at each element or aperture is divided, with one portion of the divided signal routed to either an input of a correlator, for the reference signal, or to a switch, for the non-reference signals. The remaining portion of the divided signal is routed to a power combiner, which combines all of the signals. Once phase adjustment is complete for one element or aperture, the switch is set to select a signal from one of the remaining elements or apertures and the process is repeated for each non-reference element or aperture in the antenna, resulting in a combiner output which is an enhanced, phase aligned output signal. These same settings can then be used during the transmit mode to transmit an enhanced, phase aligned transmitted signal from the antenna. With proper design of the switches, the signal from any element can be the reference signal.

The adjustments to the signal associated with each element or aperture are made by analyzing the phase relationship between the reference signal and each non-reference signal and using the phase adjuster associated with each respective element or aperture to compensate for any phase differences between the signals. In determining the amount of phase adjustment to set for each element or aperture, the system uses a correlator which determines a phase delay to apply to each antenna element of the system in order to achieve an enhanced signal. The correlator operates by receiving the reference and non-reference signal at an input. The two signals are then mixed to create mixed channels within the correlator. The mixed channels are then analyzed to determine a phase relationship between the reference and non-reference signal. In one embodiment, the reference and non-reference signals are divided into two sub-signals each, with one of the non-reference sub-signals routed through a ninety degree phase shifter. The two reference sub-signals are mixed with the non-reference sub-signal and the phase-shifted non-reference sub-signal to create a zero degree channel and a ninety degree channel. The correlator outputs adjustment signals to control logic which then adjusts the phase shifter for the non-reference element or aperture based on the level of the signal in the mixed channels. Additionally, the ninety degree mixed channel may also be divided into two sub-channels, and one of the sub-channels inverted, creating ninety degree and negative ninety degree mixed channels. The comparator then analyzes the level of the signal in each of the zero, ninety degree and negative ninety degree channels to output a more accurate adjustment signal to the control logic which adjusts the phase shifter associated with the non-reference element or aperture.

In another aspect, broadband signals may be brought into time alignment. Dual correlators are used to represent two channels of correlated signals. The amplitude of the signals in the respective channels are then compared to each other with a comparator. The channel with the lower amplitude is then time adjusted to bring the broadband signal into time alignment, thus increasing the gain for the broadband signal. The comparison of each correlated channel is made by splitting each of the zero degree and ninety degree channels of each correlator. These channels are then squared and summed. The squared and summed channel from each correlator channel is then compared at the comparator, and a time adjustment is made to the reference and non-reference element or aperture based on the output of the comparator.

Based on the foregoing summary, a number of advantages of the present invention are noted. An antenna apparatus is provided that improves previously developed self-steered phased arrays by using a single signal to determine the time delay required to steer the antenna elements of the system in a broadband manner. Additionally, all of the components can be analog components, allowing the system to operate throughout a large range of frequencies. The analog correlator helps to compensate for errors in the position of the elements, the pointing direction, the path length from the target to the elements (including atmospheric effects), and the position of the target. Further, for multiple aperture antennas, this method and apparatus also allows for smaller, less expensive, apertures as each aperture does not need to be scaled or amplified to compensate for as much scan loss. An even further advantage is that the apertures need not be directly adjacent to one another, and may be located some distance apart.

Other features and advantages will be apparent from the following discussion, particularly when taken together with the accompanying drawings.

DETAILED DESCRIPTION

Figure 1:
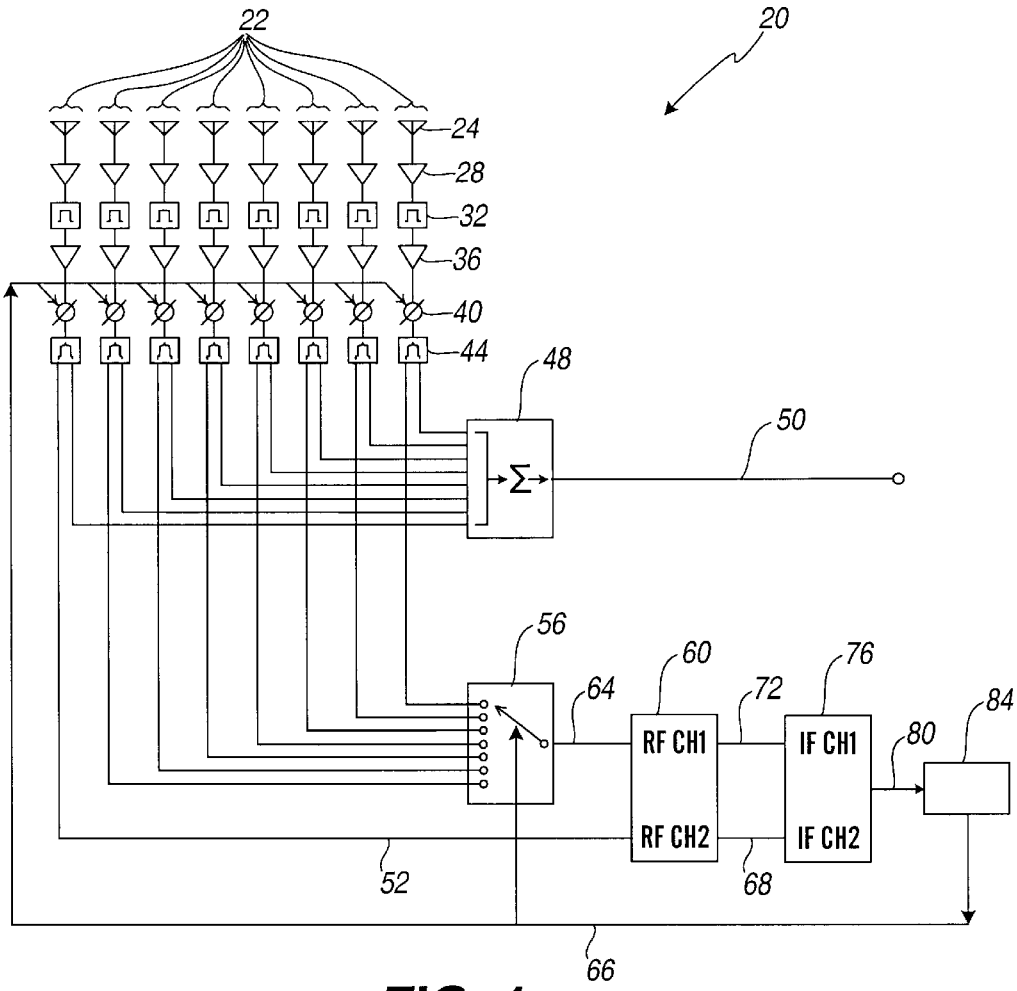
FIG. 1 is a schematic diagram of the antenna apparatus of the present invention.

A schematic diagram of the antenna apparatus is depicted in FIG. 1. The antenna apparatus 20 includes eight separate channels 22. However, the present invention is not limited in the number of channels 22 that may be included in the antenna apparatus 20. Each antenna channel 22 has an antenna element 24, a first low noise amplifier 28, a filter 32, a second low noise amplifier 36, an adjustable time delay 40, and a power divider 44. Initially, the antenna elements 24 receive a signal. The received signal can be, but need not be, a signal resulting from or associated with a transmit signal sent by the apparatus 20. The received signal could be a signal received from a source different from or entirely unrelated to the apparatus 20. The signal is then amplified at the first low noise amplifier 28, filtered at the filter 32, and amplified at the second low noise amplifier 36. The signal is then time adjusted at the adjustable time delay 40 and then split in the power dividers 44. One output from each power divider 44 is connected to the power combiner 48, where they are combined to form a signal out 50.

One of the channels is selected to be the reference channel 52. The second output of the power divider 44 for the reference channel 52 is sent directly to a downconverter 60, and the second output of the power dividers 44 of the remaining channels is routed to a switch 56. One of the remaining channels is selected in the switch 56 and sent to the second channel of the downconverter 60 as a non-reference channel 64. The downconverter 60 synchronously down-converts these two RF signals and produces a corresponding intermediate frequency(IF) reference signal 68 and an IF non-reference signal 72 at 36 MHz. These IF signals are then routed to a correlator 76, which will be described in detail below, which determines the relative phase relationship between the two signals.

The correlator 76 outputs three digital signals 80 that, collectively, are reflective of the phase relationship of the IF signals. These digital signals are read by the control logic 84. The control logic 84 determines the adjustment to the time offset required by the adjustable time delay 40 associated with the non-reference channel 64 to bring the reference channel 52 and the currently selected non-reference channel 64 closer to phase alignment. This adjustment to the offset is set by the control logic 84 via control logic output signal 66. Next, the control logic 84 rechecks the relative phase difference for the same two channels in the correlator 76, and readjusts the adjustable time delay 40 associated with the selected non-reference channel 64 again, as necessary. Once phase aligned at the correlator, the two signals will also be phase aligned at the power combiner 48, enhancing the gain of the signal out 50.

The control logic 84 then sets the switch 56 via the control logic output signal 66 to select another channel, and the process is repeated. After all channels have been phase aligned relative to the reference channel 52, the cycle is repeated to provide dynamic correlation of all of the channels. Since all channels are phase aligned, the input to the power combiner 48 will be phase aligned as well, working to enhance the signal to noise ratio of the antenna apparatus 20. Once all of the channels are phase aligned, these same settings can be used during a transmit mode of the antenna, providing enhanced gain for the transmitted signal.

Figure 2:
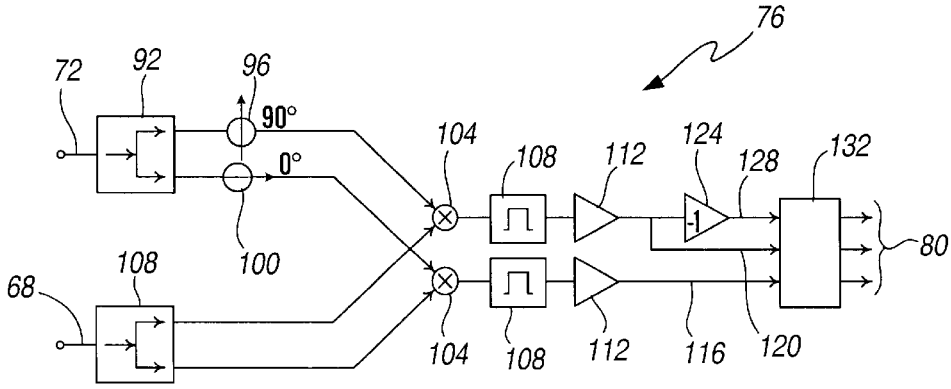
FIG. 2 is a schematic diagram of the correlator circuit used in the antenna apparatus.

Referring now to FIGS. 1 and 2, the operation of the correlator 76 will be described. FIG. 2 shows a schematic representation of the correlator 76. The correlator 76 has two IF inputs, one routing from the IF reference channel 68 and the other routing from the IF non-reference channel 72. The IF non-reference channel 72 is routed to a first splitter 92. The first output of this first splitter 92 is routed through a ninety degree phase shifter 96, and the second output of this first splitter 92 is routed through a zero degree phase shifter 100. The purpose of these fixed phase shifts is to create fixed phase comparisons for the correlator logic. Each of these two signals is sent to a port of two mixers 104. The IF reference channel 68 is also split at a second splitter 108 with the outputs of the splitter 108 being routed to the second port of each of the mixers 104. The mixer 104 outputs are dc signals which are routed through a filter 108 and an amplifier 112. The amplifiers 112 output a zero degree channel 116 and a ninety degree channel 120. The ninety degree channel 120 is split, with one portion being routed through an inverter 124 to produce a negative ninety degree channel 128. The three output channels uniquely describe the phase differences between the two input IF channels.

Figure 3:
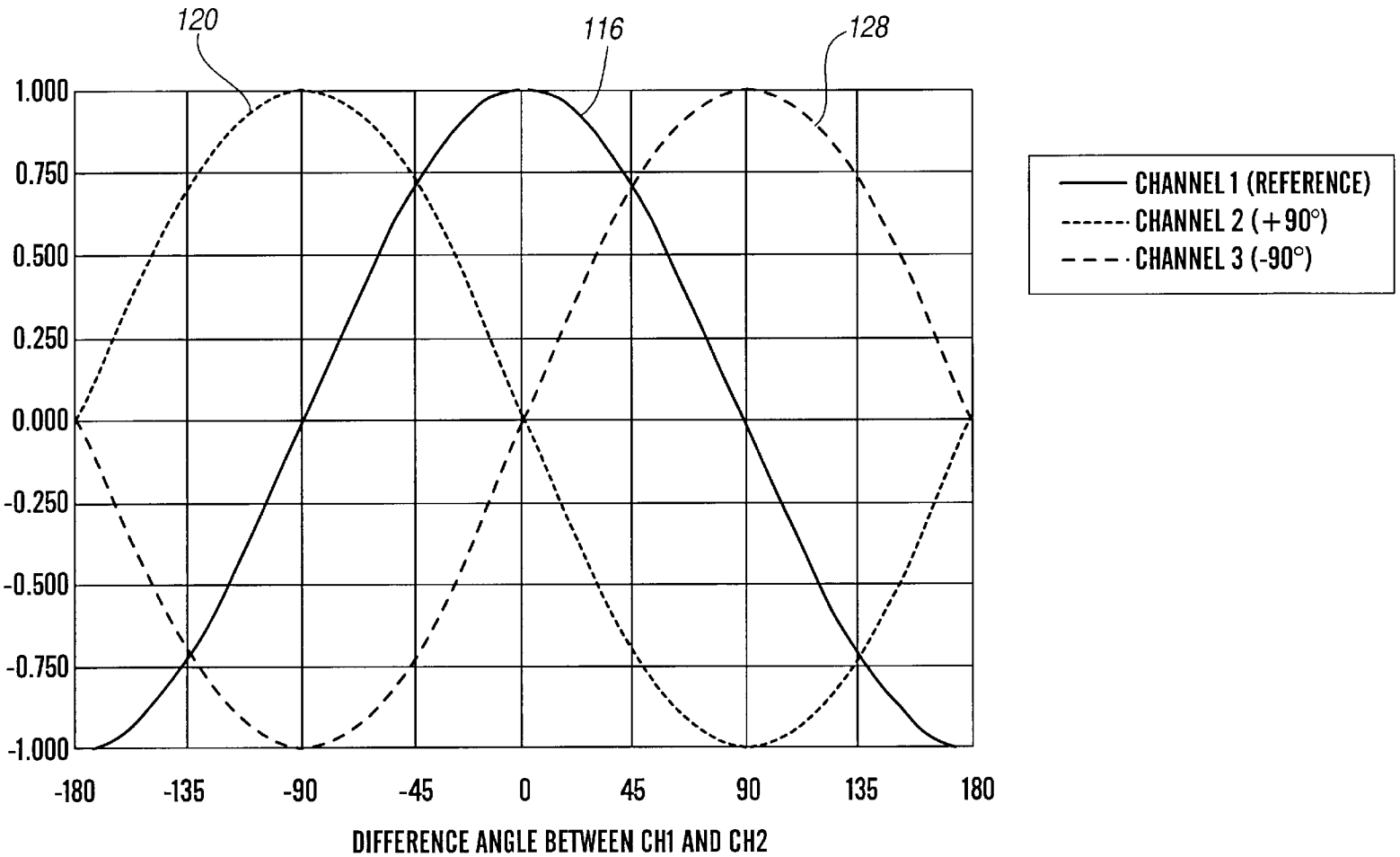
FIG. 3 shows a graphical representation of the magnitude of the zero degree correlator channel, ninety degree correlator channel and negative ninety degree correlator channel as a function of difference angle between the reference channel and non-reference channel.

A theoretical plot of the signal associated with these correlator outputs is shown in FIG. 3. If the relative phase offset between the IF reference channel 68 and the IF non-reference channel 72 is zero degrees, then the output of the zero degree correlator channel 116 will be at a maximum, and the output of the ninety degree correlator channel 120 and the negative ninety degree correlator channel 128 will both be zero. If the relative phase offset between the IF reference channel 52 and the IF non-reference channel 64 is negative ninety degrees, then the output of the zero degree correlator channel 116 will be zero, the output of the ninety degree correlator channel 128 will be a maximum and the output of the negative ninety degree channel 128 will be a minimum.

With reference again to FIG. 2, these three correlator outputs are input into a comparator circuit 132 that produces three digital outputs 80 that uniquely describe the regions of the difference phase angle between the IF reference channel 68 and the IF non-reference channel 72. These three digital outputs 80 are read by the control logic 84 which in turn determines the adjustable time delay 40 settings using an output adjusting signal for the non-reference channel 64 required to drive the phase difference of the two correlator inputs towards zero.

Figure 4A:
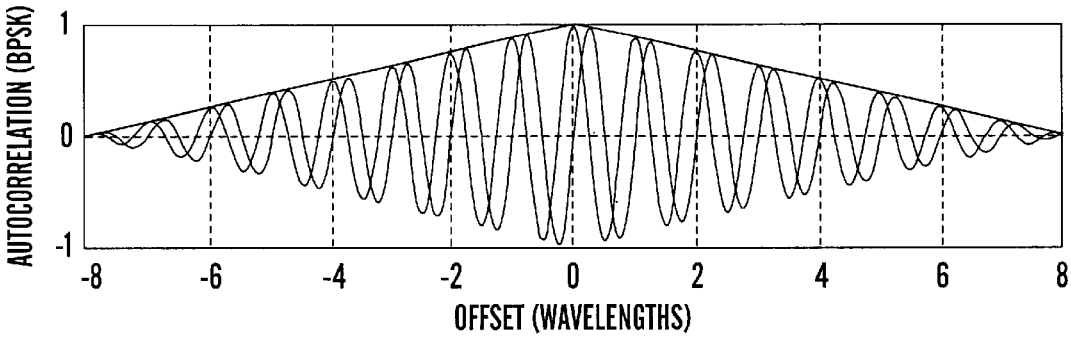
FIG. 4A shows a graphical representation of the transfer function of time correlation for a BPSK broadband signal.
Figure 4B:
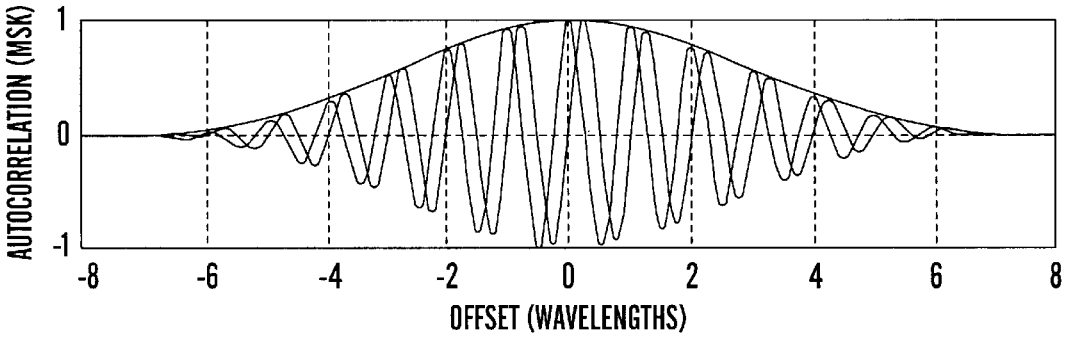
FIG. 4B shows a graphical representation of the transfer function of time correlation for a MSK broadband signal.

With respect to broadband signals, however, phase correlation of two channels may not provide an optimal output. Two incoming narrow bandwidth signals may be correlated in phase alone to achieve an optimal output, since as time varies, correlation is achieved in 360-degree integral multiples of phase. However, for wider bandwidth signals phase correlation alone may not provide an optimal output. FIGS. 4A and 4B show transfer functions of time correlation for two broadband signals. A BPSK broadband signal is shown in FIG. 4A, and a MSK broadband signal is shown in FIG. 4B. Here, the correlated signal amplitude is dependent on the time alignment of the two incoming channels. Phase correlation alone may correlate on a sub-optimal signal offset.

Figure 5:
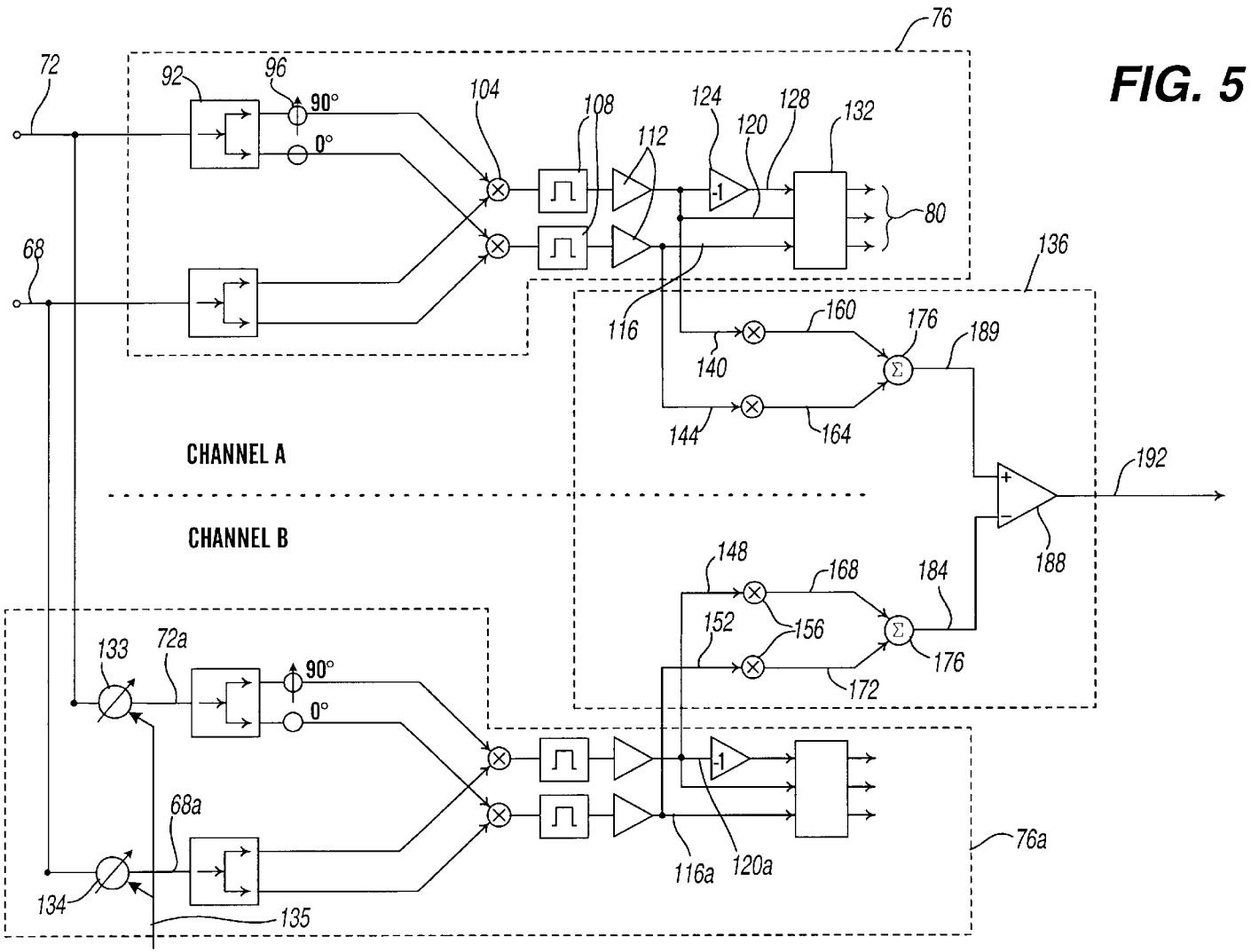
FIG. 5 is a schematic diagram of the dual correlator circuit and comparator circuit of one embodiment of the invention.
Figure 6:
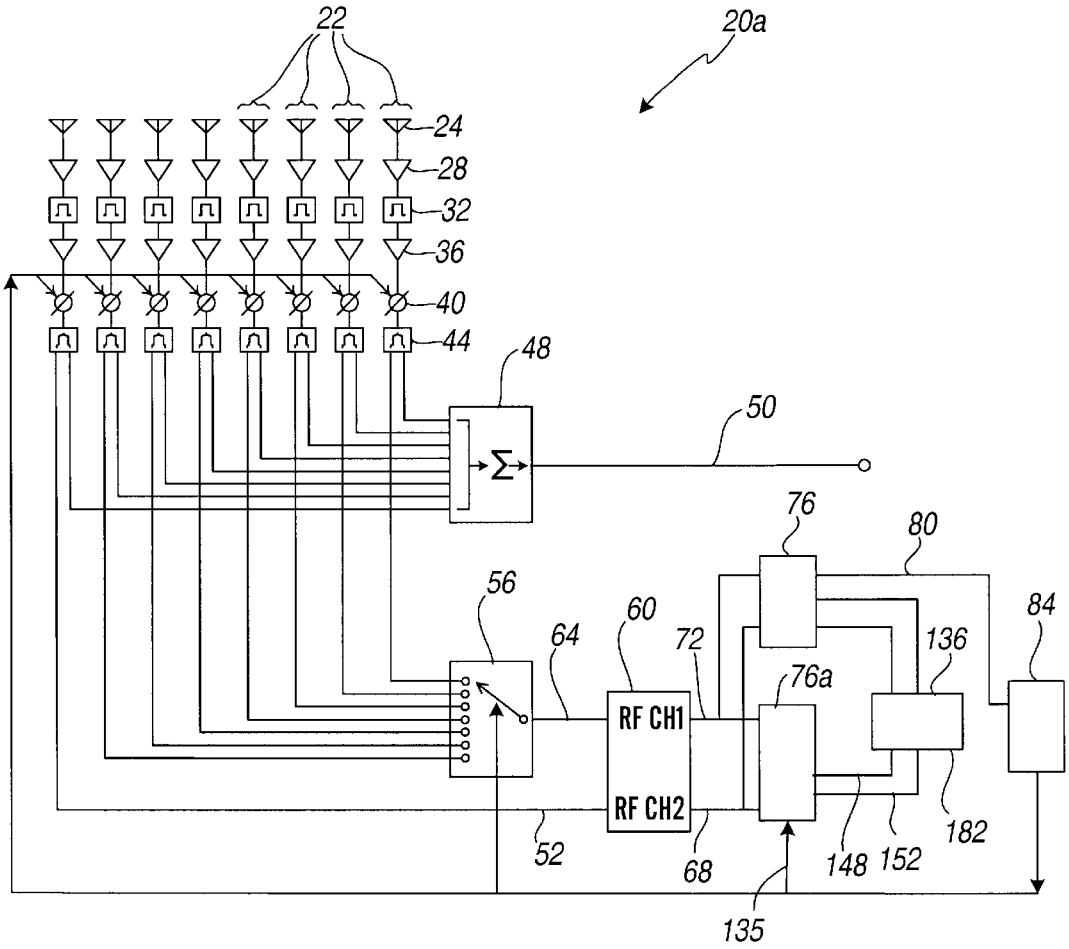
FIG. 6 is a schematic diagram of the antenna apparatus including the dual correlators and comparator circuitry of one embodiment of the invention.

This is accounted for in one embodiment by adding additional comparison circuitry, which will now be described in detail with reference to FIGS. 5 and 6. In this embodiment, the antenna apparatus 20*a* compensates for a sub-optimal signal by forming a "correlation envelope." This correlation envelope is formed by adding an additional correlator circuit 76*a* to the antenna apparatus 20 as previously described. This second correlator circuit 76*a* has two IF inputs, one routing from the IF reference channel 68 and the other routing from the IF non-reference channel 72. The IF non-reference channel 72 is routed through an adjustable time delay circuit 133, and the IF reference channel 68 is routed through an adjustable time delay circuit 134. The adjustable time delay circuits 133, 134 are adjusted by a delay signal 135 from the control logic 84 to provide a preset time offset to both the IF reference channel 68 and the IF non-reference channel 72. This results in a time-delayed IF reference channel 68*a*, and a time-delayed IF non-reference channel 72*a*. These two time-delayed channels are then routed through circuitry which is identical to the correlator 76, as described above.

The correlator circuit outputs are then analyzed by comparison circuitry 136. The comparison circuitry 136 takes a first in-phase channel ($I_1$) 140 from the ninety degree channel 120 of the first correlator circuit 76, and a first quadrature channel ($Q_1$) 144 from the zero degree channel 116 of the first correlator circuit 76. The comparison circuitry 136 takes a second in-phase channel ($I_2$) 148 in-phase channel ($I_1$) 140 from the ninety degree channel 120*a* of the second correlator circuit 76*a*, and a second quadrature channel ($Q_2$) 152 from the zero degree channel 116*a* of the second correlator circuit 76*a*. Each of these channels is then squared at a multiplier 156 creating a first squared in-phase channel ($I_1^2$) 160, a first squared quadrature channel ($Q_1^2$) 164, a second squared in-phase channel ($I_2^2$) 168, and a second squared quadrature channel ($Q_2^2$) 172. The squared output of the first squared in-phase channel 160 and the first squared quadrature channel 172 are then summed at a summer circuit 176 creating a first correlation envelope 180 consisting of a summed channel of the first squared in-phase channel and the first squared quadrature channel ($I_1^2+Q_1^2$). The squared output of the second squared in-phase channel 168 and the second squared quadrature channel 172 are then summed at a summer circuit 176 creating a second correlation envelope 184 consisting of a summed channel of the second squared in-phase channel and the second squared quadrature channel ($I_2^2+Q_2^2$). Next, the correlation envelopes are compared at a comparator circuit 188 which outputs a comparison or control signal output 192.

The control logic 84 reads this comparison output 192 and outputs an adjusting signal to adjust the time delay circuit 40 associated with the appropriate channels to bring the signals into closer time alignment. The control logic 84 then adjusts the adjustable time delay circuits 133, 134 and repeats the process until the comparator output 192 is maximized. When the comparator output is maximized, the reference channel 52 and non-reference channel 64 are both phase and time aligned. The control logic 84 then selects another non-reference channel 64 at the switch 56 and repeats the same process for this next signal. Once all of the signals are phase and time aligned, the cycle is repeated to provide dynamic phase and time correlation of all of the channels. Since all channels are phase and time aligned, the input to the power combiner 48 will be phase and time aligned as well, working to enhance the signal to noise ratio of the antenna apparatus 20*a*. Once all of the channels are phase and time aligned, these same settings can be used during a transmit mode of the antenna, providing enhanced gain for the transmitted signal. In another embodiment, each of the in-phase channels 140, 148 and the quadrature channels 144, 152, are routed to a computer which uses software to perform all of the functions of the comparison circuitry.

Figure 7:
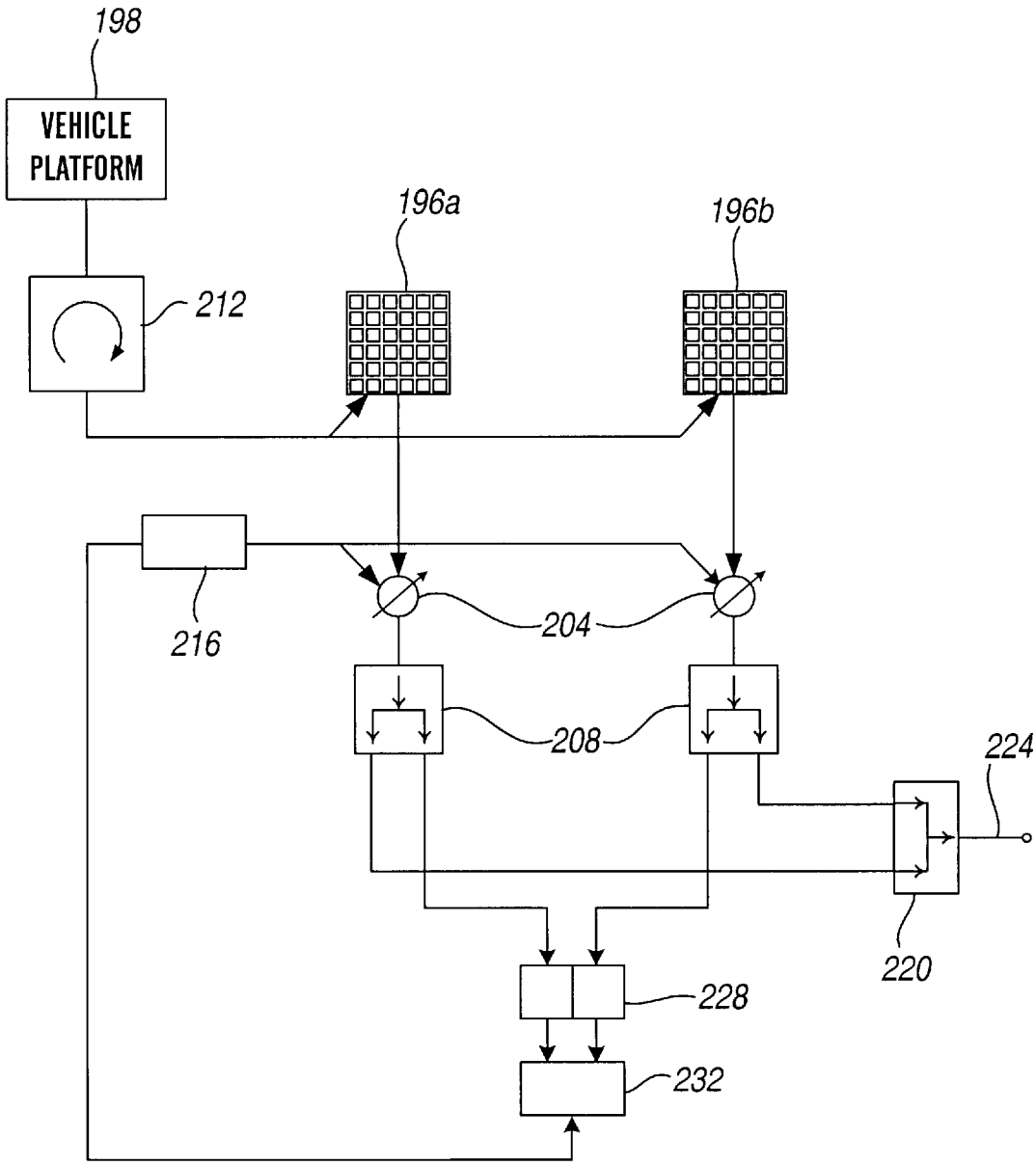
FIG. 7 is a schematic diagram showing an antenna apparatus including two phased array antennas and the correlating and combining circuitry associated therewith.

Referring now to FIG. 7, the ability to combine signals from adjacent phased array apertures will now be described. A block diagram of the combining system may be found in FIG. 7. It is comprised of a phased array system that includes at least two apertures 196*a*, 196*b*, a phase shifter 204, and a power splitter 208. Each sub-array 196*a*, 196*b* creates antenna beams that are electronically steered in both azimuth and elevation to +/−60 degrees off of normal. Each aperture 196*a*, 196*b* contains typical hardware associated with a phased array antenna, namely antenna elements, amplifiers, filters and phase shifters associated with each element, combining circuitry for forming an output signal, and control circuitry for controlling the phase shifters and steering the beam. The output signal can be, in one embodiment, obtained like the signal out 50 of FIG. 1, except that no control logic signal 66 and no power dividers are utilized; instead, some other logic might be employed to control phase shifters that may be different from the adjustable time delay circuitry 40. A positional sensor 212 sends positional data to each aperture 196*a*, 196*b*, which is used to steer the beams. The positional data is obtained from a vehicle platform 198. It will be understood that a positional sensor is needed only in applications which have vehicle platforms, such as a ship or an aircraft. The positional sensor 212 is used in these applications to provide geographical data to each aperture 196 and is used for steering purposes. The output signal from each aperture 196*a*, 196*b* is then sent through a phase shifter 204 and then routed to the associated power splitter 208. The first output of each power splitter 208 is sent to an input of the RF power combiner 220 where the signals are combined to create a signal out 224. The second output of each power splitter 208 is sent to an input of a dual channel downconverter 228. Here, the received signals are synchronously downconverted to 36 MHZ and sent to a correlator circuit 232. As described above, the correlator circuit 232 is equivalent to the correlator circuitry 76 of FIG. 5 and determines the relative phase and time relationships of the signals from the two channels using a reference and a non-reference channel. This relative phase and time comparison is used to time-align the two signals by changing the time offsets in the phase shifter 204 at the input to the power splitters 208. Once the signals are time aligned at the correlator 232, the signals will also be time aligned at the RF power combiner 220. When this is achieved, the signal to noise ratio is enhanced, and the signal from each aperture 196 will be phase and time aligned with the other. With each aperture 196 time aligned, one is able to combine received and transmitted signals using all of the apertures simultaneously.

Figure 8A:
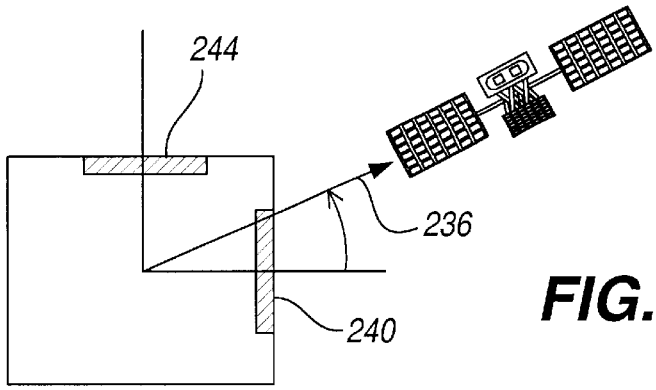
FIGS. 8A through 8C are illustrations showing a handoff of a signal between two phased array apertures in one embodiment of the invention.
Figure 8B:
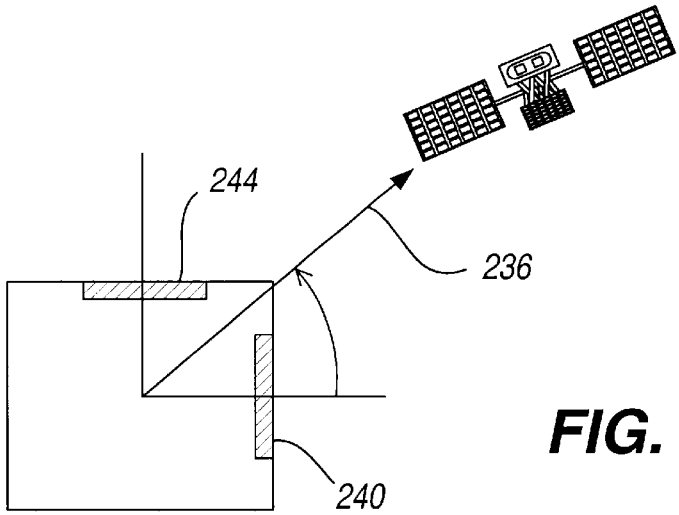
Figure 8C:
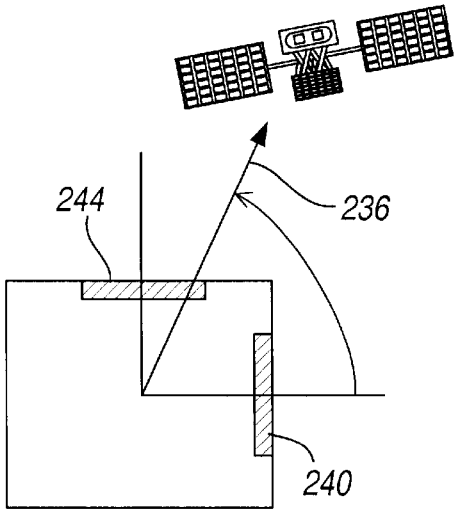

With reference now to FIGS. 8A through 8C, the handoff of a signal 236 from a first aperture 240 to a second aperture 244 of a phased array system will now be described in detail. The apertures are shown here as being on two sides of a cube, however it should be noted that other configurations are also possible, so long as there is some overlap in the maximum scan angles between the apertures. In one embodiment, the phased array apertures can scan up to 60 degrees from normal to the array, thus giving a 30 degree overlap in scan angles between the two apertures placed on adjacent sides of a cube, as shown in FIGS. 8A through 8C. Referring now to FIG. 8A, as the signal 236 is steered from normal to the first aperture 240 to angles closer to the second aperture 244, the signal is received and/or transmitted from the first aperture 240 only. While the scan angle is less than 30 degrees to the first aperture 240 normal (−60 degrees to the second aperture 244 normal), the signals from the apertures are not combined. As the scan angle continues from 30 degrees to 60 degrees to the first aperture 240 normal (−60 to −30 degrees to the second aperture 244 normal), as shown in FIG. 8B, the two signals from the adjacent apertures are correlated, time aligned and combined as described above. Finally, as the scan angle continues beyond 60 degrees from the first aperture 240 normal (−30 degrees to the second aperture 244 normal), as shown in FIG. 8C, the signal 236 is received or transmitted from the second aperture 244 only. This combining function results in an output signal with a higher energy level than that of either aperture alone. In fact, the peak system gain now occurs at 45 degrees between adjacent apertures, and the minimum gain now occurs at a scan angle of slightly less than 30 degrees, before the signals are combined. Consequently, array gain can be reduced by about 2 dB, reducing typical aperture size and cost by approximately 30%. It also performs seamless handoffs as the signal 236 is steered around a corner since, as signals from the two adjacent apertures are correlated and combined for scan angles of 30 to 60 degrees to the normal of the first aperture 240, there is no bit de-synchronization, because phase continuity in the signal 236 is naturally maintained.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to-explain the best modes presently known of practicing the inventions and to enable others skilled in the art to utilize the inventions in such, or in other embodiments, and with the various modifications required by their particular application or uses of the invention. It is intended that the appended claims be construed to include alternative embodiments to the extent permitted by the prior art.

What is claimed is:

1. A method for adjusting signals received by a plurality of antenna elements of an array antenna, comprising:

receiving a first signal using at least a first antenna element of said array antenna;

receiving a second signal using at least a second antenna element of said array antenna;

generating an adjusting signal using said first signal and said second signal, wherein said generating step is conducted without using a velocity signal associated with movement of said array antenna and without using any signal, having one or more frequencies, that is provided independently of at least one of said first and second signals, said adjusting signal being dependent on each of a time correlating signal and a phase correlating signal, said time correlating signal being related to an integer wavelength offset associated with said first and second antenna elements and said phase correlating signal being related to a phase difference associated with said first and second antenna elements; and controlling a delay associated with said second signal after said generating step using said adjusting signal.

2. A method for adjusting signals received by a plurality of antenna elements of an array antenna, comprising:

receiving a first signal using at least a first antenna element of said array antenna;

receiving a second signal using at least a second antenna element of said array antenna;

generating an adjusting signal using said first signal and said second signal, wherein said generating step is conducted without using any-signal, having one or more frequencies, that is provided independently of at least one of said first and second signals, and wherein said generating step includes producing signals related to a first correlation envelope and a second correlation envelope using at least one of said first and second signals; and controlling a delay associated with said second signal after said generating step.

3. A method, a claimed in claim 2, wherein:

said generating step includes determining a control signal having an amplitude using said signals related to said first correlation envelope and said second correlation envelope.

4. A method, as claimed in claim 3, wherein:

said adjusting signal depends on said amplitude of said control signal.

5. A method, as claimed in claim 1, wherein:

said generating step includes producing at least an in-phase signal, and a quadrature signal using said first and second signals.

6. A method, as claimed in claim 1, wherein:

said controlling step includes adjusting at least one of a time delay and a phase delay.

7. A method, as claimed in claim 1, wherein:

said adjusting signal depends on whether a control signal has a maximum amplitude.

8. A method, as claimed in claim 1, wherein:

said generating step includes determining a phase relationship between said first signal and said second signal using a correlator circuit.

9. A method, as claimed in claim 8, wherein:

said controlling step includes using said adjusting signal to adjust a time delay circuit associated with said second signal.

10. A method for adjusting signals received by a plurality of antenna elements of an array antenna, comprising:

receiving a first signal using at least a first antenna element of said array antenna;

receiving a second signal using at least a second antenna element of said array antenna;

generating an adjusting signal using said first signal and said second signal, wherein said generating step is conducted without using any signal, having one or more frequencies, that is provided independently of at least one of said first and second signals, and wherein said generating step includes:

dividing said first signal at a first power divider to create a first divided signal and a second divided signal;

dividing said second signal at a second power divider to create a third divided signal and a fourth divided signal;

routing said second and fourth divided signals to a power combiner to create a combined output signal; and determining a phase relationship between said first and second signals using said first divided signal and said third divided signal; and controlling a delay associated with said second signal after said generating step.

11. A method, as claimed in claim 10, wherein said determining step includes:

routing said first divided signal to an input of a correlator circuit; routing said third divided signal to a switch;

selecting said third divided signal at said switch to create a selected signal; and routing said selected signal to a second input of said correlator circuit.

12. A method, as claimed in claim 1, wherein:

said generating step is conducted with said first signal only.

13. An antenna apparatus, comprising:

a plurality of antenna elements including at least first and second antenna elements, said first antenna element receiving a first signal and said second antenna element receiving a second signal; and a determining circuit that includes processing circuitry that generates signals related to a first correlation envelope and a second correlation envelope and control circuitry responsive to said signals related to said first and second correlation envelopes to output a control signal having an amplitude, said control signal being used in controlling at least one of a time delay and a phase delay associated with said second signal.

14. An apparatus, as claimed in claim 13, wherein:

said control circuitry includes control logic to determine the presence of a predetermined amplitude associated with said control signal.

15. An apparatus, as claimed in claim 14, wherein;

said predetermined amplitude is a maximum amplitude associated with said control signal.

16. An apparatus, as claimed in claim 13, wherein:

said control circuitry includes control logic to ascertain whether a control signal having a predetermined amplitude is present.

17. An apparatus, as claimed in claim 13, wherein:

said processing circuit provides an in-phase signal and a quadrature signal using said first and second signals.

18. An apparatus, as claimed in claim 13, wherein:

said processing circuitry includes a correlator circuit and said control circuitry includes a comparator circuit.

19. A method for combining signals received by at least two displaced apertures of a multiple aperture antenna, comprising:

providing at least first and second apertures having a first plurality of antenna elements and a second plurality of antenna elements, respectively;

outputting a first aperture output signal and a second aperture output signal using signals obtained from said first plurality of antenna elements and said second plurality of antenna elements, respectively; and determining a combined adjusting signal using said first and second output signals, wherein said combined adjusting signal depends on signals related to a first correlation envelope and a second correlation envelope; and controlling a delay related to said first and second aperture output signals using said combined adjusting signal.

20. A method, as claimed in claim 19, wherein:

said first aperture output signal relates to signals received by said first plurality of antenna elements based on a transmit signal from said multiple aperture antenna.

21. A method, as claimed in claim 20, wherein:

said combined adjusting signal depends on a determination related to whether a control signal has a maximum amplitude.

22. An antenna apparatus, comprising:

a first aperture including a first plurality of antenna elements that provides a first aperture output signal;

a second aperture including a second plurality of antenna elements that provides a second aperture output signal; and determining circuitry responsive to said first and second aperture output signals to provide a combined adjusting signal used to adjust a delay related to said first and second aperture output signals, said combined adjusting signal being dependent on each of a time correlating signal and a phase correlating signal, said time correlating signal being related to an integer wavelength offset associated with said first and second antenna apertures and said phase correlating signal being related to a phase difference associated with said first and second antenna apertures.

23. An antenna apparatus, comprising:

a first aperture including a first plurality of antenna elements that provides a first aperture output signal;

a second aperture including a second plurality of antenna elements that provides a second aperture output signal; and determining circuitry responsive to said first and second aperture output signals to provide a combined adjusting signal used to adjust a delay related to said first and second aperture output signals, wherein said determining circuitry includes processing circuitry that generates signals related to first and second correlation envelopes obtained from said first and second aperture output signals.

24. An antenna apparatus, as claimed in claim 22, wherein:

said combined adjusting signal delays said first and second aperture output signals in each of time and phase.

25. An antenna apparatus, as claimed in claim 22, further including:

a positional sensor that provides information related to at least a physical position of said first.

26. An antenna apparatus, as claimed in claim 22, further including:

at least a third aperture including a third plurality of antenna elements.

* * * * *